United States Patent [19]

Bianchi et al.

[11] 4,437,517

[45] Mar. 20, 1984

[54] SLIP MECHANISM FOR SUBTERREANEAN WELLS

[75] Inventors: David C. Bianchi, Conroe; Talmadge L. Crowe, Houston, both of Tex.

[73] Assignee: Baker International Corporation, Orange, Calif.

[21] Appl. No.: 307,972

[22] Filed: Oct. 2, 1981

[51] Int. Cl.[3] ..... E21B 33/128; E21B 33/129

[52] U.S. Cl. ..... 166/120; 166/217; 166/212

[58] Field of Search ..... 166/216, 217, 134, 212, 166/138, 120, 121, 122

[56] References Cited

U.S. PATENT DOCUMENTS

| | | | |
|---|---|---|---|
| 2,546,377 | 3/1951 | Turechek | 166/134 X |
| 3,136,364 | 6/1964 | Myers | 166/120 |
| 3,456,723 | 7/1969 | Current et al. | 166/120 |
| 4,059,150 | 11/1977 | Manderscheid | 166/216 X |
| 4,263,968 | 4/1981 | Garner | 166/212 X |

*Primary Examiner*—Ernest R. Purser
*Assistant Examiner*—Michael Starinsky
*Attorney, Agent, or Firm*—Norvell & Associates

[57] ABSTRACT

A slip mechanism is provided to effect the anchoring of an inner tubular conduit to the inner wall of a larger surrounding tubular conduit such as the casing of the well. Two annular cam elements are disposed in axial alignment for slidable movements on the inner tube. Such cam elements have a plurality of peripherally spaced, axially extending, slots formed in their peripheries. A set of first slip members are radially slidably disposed in a portion of the axial slots and a set of second slip members are radially slidably disposed in the remainder of the axial slots. The slips are provided with an inclined cam surface which cooperates with a correspondingly shaped surface provided in the slot receiving that portion in the cam element. The slips have external teeth and may be of identical configuration, but are reversed when inserted into oppositely extending slots provided in separate cam elements. Axial movement of the two cam elements toward each other effect the concurrent radial outward displacement of both sets of slips and the simultaneous wedging engagement of all the slips with the casing wall. Each slip is wedged between one cam element and the casing and is attached to the other cam element preventing retraction of the cam elements and inadvertent dislodging of the slip mechanism due to extrusion of the packing elements and to pressure differentials existing in the annulus between the inner and outer conduit.

17 Claims, 8 Drawing Figures

SLIP MECHANISM FOR SUBTERREANEAN WELLS

BACKGROUND OF THE INVENTION

1. Field of the Invention

The invention relates to a slip mechanism for anchoring an inner tubular conduit to the inner bore of a surrounding outer tubular conduit, for example, anchoring of a production string to a well casing.

2. Description of the Prior Art

There is a need for devices, commonly called slip mechanisms, for achieving the anchoring of a small diameter tubular member to the bore wall of a surrounding larger diameter tubular member, generally the well casing. Such devices are employed, for example, in packers, hangers and bridge plugs. The commonly utilized forms of slip mechanism involve axially spaced upper and lower cone or cam elements which are respectively mounted for relative axial sliding movement between the two tubular members to be anchored. Each cam or cone element is provided with a plurality of peripherally spaced, axially extending slots and each slot slidably accommodates a slip member which is of generally rectangular configuration and has wall bore engaging teeth formed on its outer side. The bottom portion of one end of each slip member is shaped to form a cam surface which co-operates with a correspondingly shaped bottom surface of the respective axial slot to urge the slip outwardly. All of the teeth of the slip members mounted in the lower cone element may be downwardly inclined to engage the bore wall of the outer tubular member and prevent downward movement of the slips and associated cone, while the engaging teeth of the set of slip elements mounted in the other cone element may be inclined in the opposite direction and act to engage the outer bore surface and prevent upward movement.

When such slip elements are employed in a packer, the two cam elements and abutment blocks are normally separated by annular bands of elastomeric material. Thus, axial movement of the two cone elements toward each other effect the concurrent expansion of the slip elements into engagement with the bore wall of the outer tubular member and at the same time effect the compression of the elastomeric elements between the annular abutment blocks to cause a radial expansion of such elements into sealing engagement with the same bore wall. The compressive forces required to effect such radial expansion of the slip elements and elastomeric seal elements may be generated either by mechanical or hydraulic actuation by elements disposed respectively above and below the upper and lower cone elements. While not strictly necessary, it is desirable that each of the slip elements have an annular segment cross section, and this necessarily results in a complex structure to produce by conventional machining operations.

Additionally, due to the fact that each set of slip elements is separately actuated by relative axial movements of its respective supporting cone and abutment block members, it generally happens that one set of slip elements engage the bore of the outer wall prior to the other set, thus, additional axial movement of the actuating member for the other set of slip mechanisms must be provided in order to insure the rigid engagement of its cutting teeth with such bore surface. The greater the extent of axial movement required to effect the setting of both sets of slip mechanisms, the more complex and expensive will be the actuating mechanism for the slip mechanisms.

SUMMARY OF THE INVENTION

A slip mechanism is provided wherein both sets of slips, those acting both in an upward direction and in a downward direction, are mounted directly between the two cone or cam elements and the employment of intermediate abutment blocks to mount the other ends of the slips is completely eliminated. Thus, the upper and lower cone members are respectively provided with axially extending slots, with each slot being designed to receive a slip. Those slots receiving slips acting in the downward direction are provided with an inclined bottom surface which functions as a cam in cooperation with a similarly inclined bottom surface of the portion of the slot in the bottom cone element in which it is received. Thos axially extending slots receiving the slips acting in the upward direction are provided with an inclined bottom surface which cooperates with the similarly inclined bottom surface of the portion of the slot formed in the upper cone element. Each cam element has T-shaped grooves axially aligned with the slots in the opposite cam element. Each slip in turn has a T-shaped end which is received in the cooperating T-shaped groove.

The axial movement of the upper and lower cone or cam elements toward each other will effect the simultaneous radial expansion of both sets of slips and the wedging engagement of both sets of slips with the bore of the outer wall is substantially concurrent, thus eliminating the necessity for substantial additional axial movement of one cone element after the other cone element has reached a set position.

When a slip mechanism embodying this invention is applied to a tool such as a packer, the annular elastomeric seal elements are disposed adjacent one end of the slip mechanism and are compressed between such end and an actuating member applied to the other end of the elastomeric seal elements. Thus, the compressive forces are transmitted through the elastomeric seal elements to the slip elements instead of the reverse relationship heretofore commonly employed in packers. After the tool has been set ratcheting engagement will prevent the components of the tool from relative movement in the conventional releasing direction.

When the slip elements are expanded to their set position, subsequent compressive forces applied through the annular elastomeric seal elements effect the further radial expansion of such elastomeric elements into sealing engagement with the wall of the outer tubular member. This arrangement has the distinct advantage that additional compressive forces may be applied from time to time to the annular elastomeric seal elements to readily overcome any loss of sealing effectiveness produced by extrusion of the elastomeric material. Such additional movement is obviously accomplished without requiring any movement by any of the slip elements.

The engagement of each slip with both cam elements also prevents inadvertent movement of the cam elements away from each other. Such inadvertent movement, eventually resulting in dislodging or releasing the tool can occur because of the action of pressure differentials in the annulus upon components of the tool used in setting the packer. Especially where extrusion occuring in the packing elements, such factor introduces slack or play into the system, and the interconnection or engagement of each slip with each cam is necessary to prevent such inadvertent release.

DESCRIPTION OF THE PREFERRED EMBODIMENTS

Figure 2:
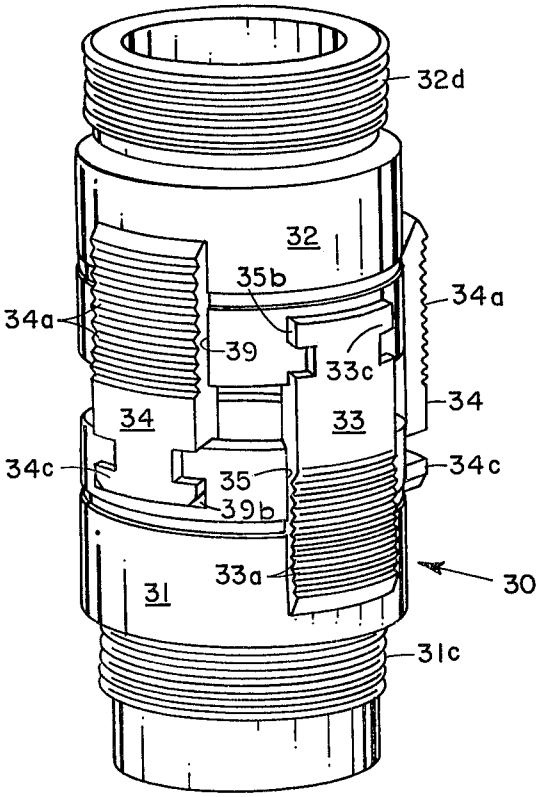
FIG. 2 is a perspective view similar to FIG. 1 but showing the slip elements in their expanded position.
Figure 1:
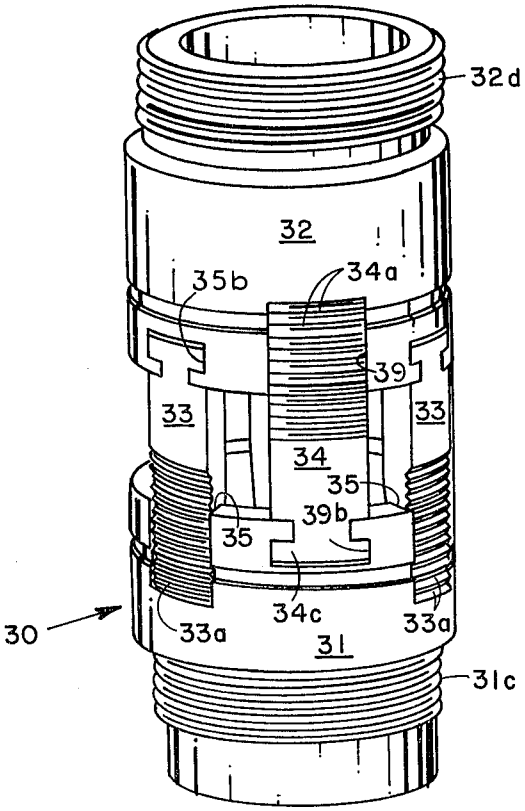
FIG. 1 is a perspective view of a slip mechanism embodying this invention shown with the slips in retracted position.
Figure 3:
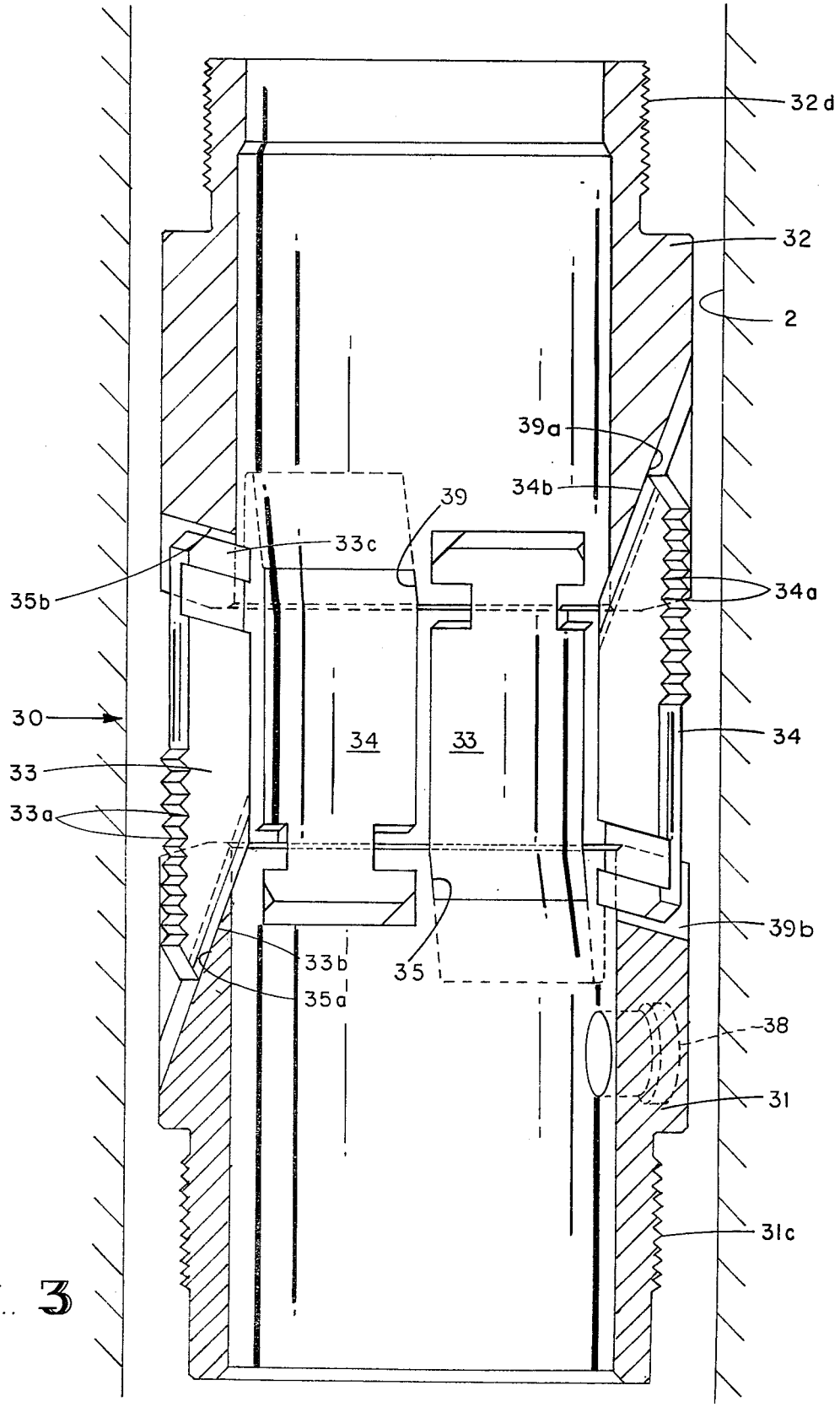
FIG. 3 is an enlarged scale vertical sectional view of FIG. 1.
Figure 4:
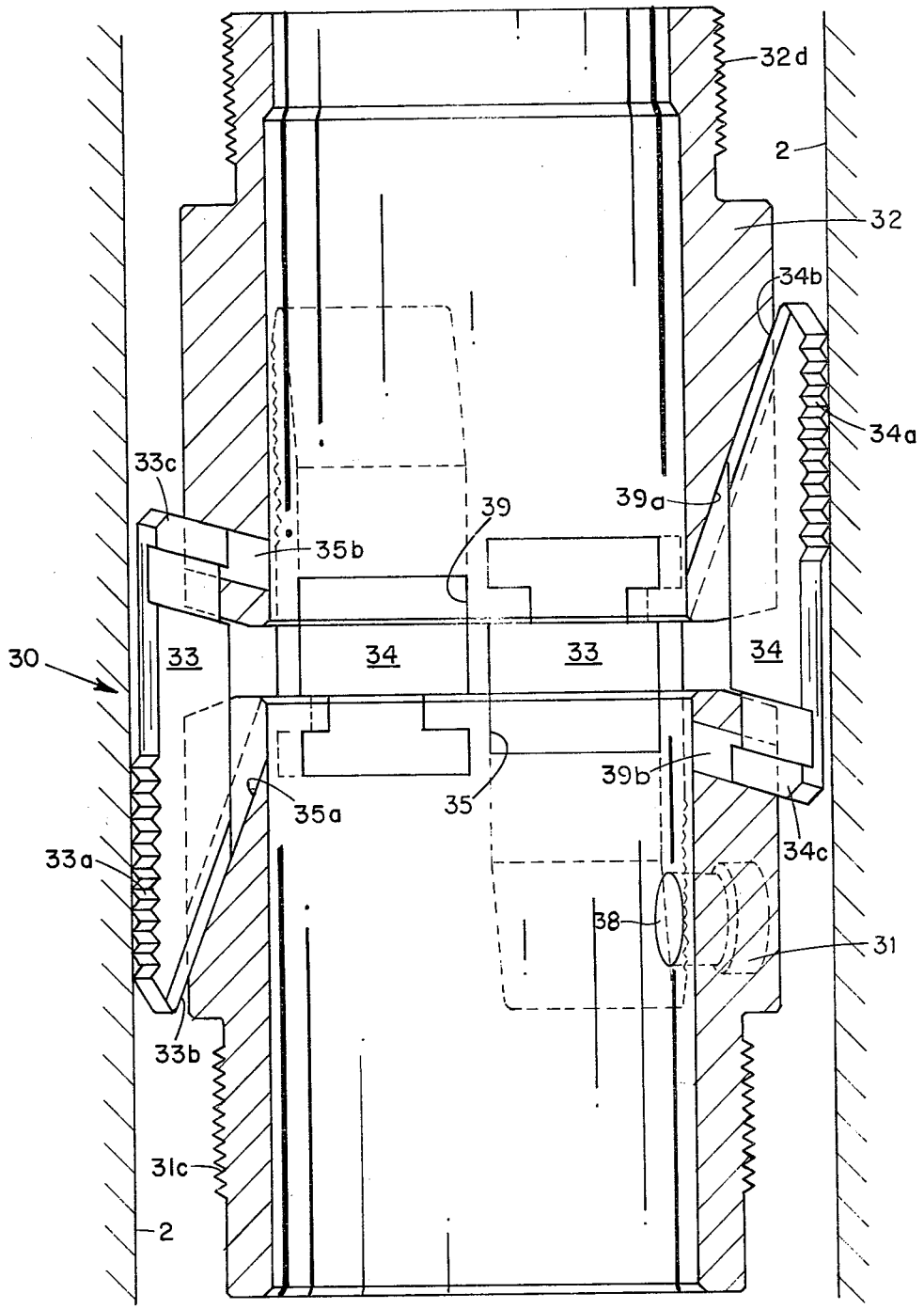
FIG. 4 is an enlarged scale vertical sectional view of FIG. 2.
Figure 5A:
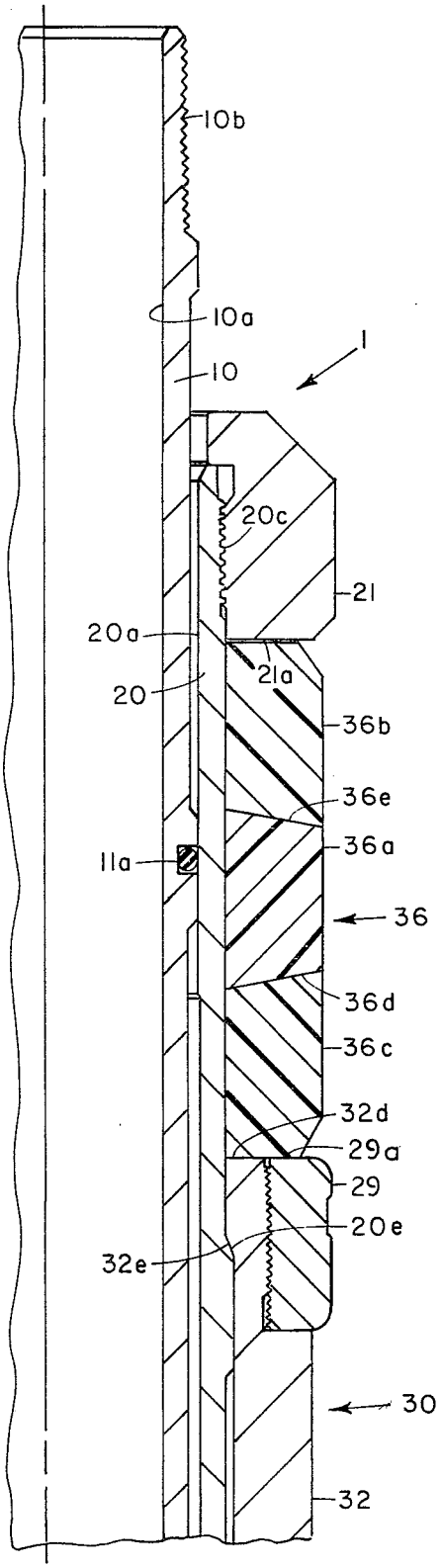
FIGS. 5*a*–5*d* collectively represent a vertical sectional view of an hydraulically actuated packer incorporating the slip mechanism of this invention, with the components of the packer shown in their run-in or retracted position, FIGS. 5*b*, 5*c* and 5*d* being respectively vertical continuations of FIGS. 5*a*, 5*b* and 5*c*.
Figure 5B:
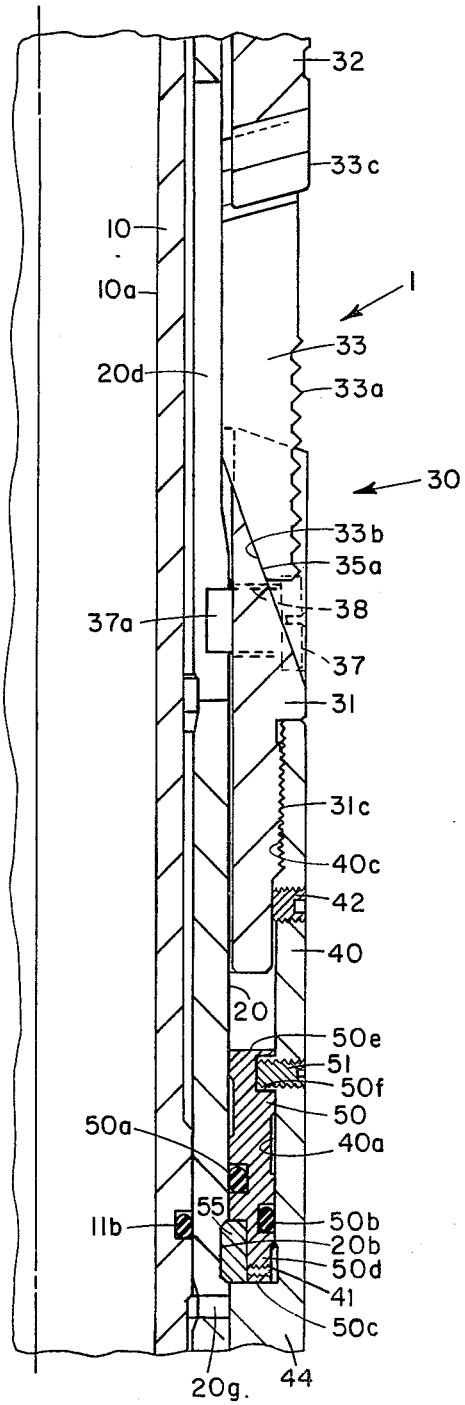

Referring first to FIGS. 1 through 4, a slip mechanism 30 embodying this invention comprises upper and lower, or first and second relatively movable housing members 32 and 31. These housing members comprise annular cam or cone elements 32 and 31 which are respectively mounted for axial slidable movement on the outer wall of a tubular member 20 (FIG. 5*b*). Each cone element 31 and 32 is provided with a plurality of peripherally spaced, axially extending slots. There are two distinct sets of such slots, namely slots 35, each configured to receive one of a set of second slips 33. The slots 36 are each configured to receive one of a set of first slips 34. Second slips 33 have outer teeth or gripping elements 33*a*, and first slips 34 have similar teeth 34*a*.

The slips 33 and 34 are actually of identical construction but are inserted in the slots 35 and 39 respectively in reversed positions. Thus, each slip 33 has a gradually inclined inner camming surface 33*b* (FIGS. 3 and 4) which cooperates with the inclined bottom surface 35*a* of the portion of the respective slot 35 that lies in lower cone 31. Additionally, each slip 33 has an acutely angled T-shaped end portion 33*c* which cooperates with a correspondingly T-shaped groove 35*b* formed in upper cone 32 and aligned with slot 35.

In like fashion the upper end of each slip element 34, has a gradually inclined inner cam surface 34*b* which cooperates with the similarly inclined bottom surface 39*a* of the respective slot 39 in upper cone 32. The other end of each slip 34 is formed as an acutely angled T-shaped member 34*c* which cooperates with a correspondingly shaped T groove 39*b* formed in lower cone 31 and also aligned with slot 39.

A threaded hole 38 may be provided in either the upper or lower cone elements 31 or 32 to receive a T bolt 37 (FIG. 5) having a square end 37*a* that cooperates with a slot 20*d* provided on the exterior of the mounting sleeve 20 to prevent relative rotation of the cam or cone elements 31 or 32 with respect to the mounting sleeve 20.

It will be apparent that when the cam or cone elements 31 or 32 are moved axially towards each other, the effect on both sets of slip elements 33 and 34 will be to concurrently urge such slips radially outwardly so that teeth 33*a* and 34*a* engage the inner wall of the outer conduit or casing 2 (FIG. 4) at substantially the same time, thus rigidly locking both sets of slips to the casing 2 and eliminating the necessity for additional movement of one set of slips relative to the other to achieve the complete locking of the slip mechanism to the casing 2.

The camming action of inner surface 34*b* of slip 34 with the bottom surface 39*a* wedges the slip against the casing 2 when cam element 31 moves toward cam element 32. This wedging engagement between first slips 34 and first cam element 32 anchors the tool against movement in a first direction toward the bottom of the well. A similar camming action between second slips 33 and second cam element 31 wedges slips 33 against the casing to prevent movement of the tool toward the surface.

Referring now specifically to FIGS. 5*a*–5*d*, there is shown the application of a slip mechanism embodying this invention to a packer 1 which is described and illustrated in detail in copending application Ser. No. 307,812, filed Oct. 2, 1981, and entitled "Fluid Pressure Actuated Well Tool".

The preferred embodiment of this tool comprises packer 1 incorporating a slip mechanism embodying this invention. Packer 1 comprises an elongated inner sleeve 10 extending the entire length of the packer and having a bore 10*a*, an upper threaded end 10*b* for securement in an inner conduit such as a production or work string, and a lower threaded end 10*c* for securement in the upper portions of a lowerly extending production or work string or, in the event that no additional equipment is to be mounted below the particular packer, the threaded end 10*c* mounts a conventional expendable plug 5 carried in an internally threaded sleeve 5*a*. Plug 5 is of the type that functions as a valve which opens by dropping the plug portion of element 5 to the bottom of the well bore upon an increase in pressure in the bore 10*a* of inner sleeve 10 in excess of that required to effect the setting of the packer.

An intermediate sleeve 20 is mounted in axially sliding relationship around the inner sleeve 10. A fluid seal 11*a* is provided in the upper portions of the wall of inner tube 10 and cooperates with the bore 20*a* of the intermediate sleeve 20 to prevent fluid passage therethrough. At a medial position of the inner sleeve 10, one or more radial ports 10*d* are provided which communicate with the annular area defined between the inner sleeve 10 and the intermediate sleeve 20. Axially spaced seals 11*b* and 11*c* are respectively provided above and below the port 10*d* to prevent fluid entering the port from entering the entire annular area defined between the inner sleeve 10 and the intermediate sleeve 20.

Intermediate sleeve 20 is free to move axially relative to the inner sleeve 10 through a limited distance defined by one or more peripherally spaced, radially disposed shear screws 65 which are provided in the bottom portions of a lower piston 60 and cooperate with a limited axial length annular groove 15*b* in a shear screw retaining sleeve 15 which is threadably secured to the bottom end of the sleeve 10 by threads 15*a*. Further details of this construction will be described hereinafter.

An outer sleeve 40 is provided in radially spaced, concentric relationship to the periphery of intermediate sleeve 20 and thus defines therebetween an annular pressure chamber 41.

A pair of annular pistons, namely an upper piston 50 and a lower piston 60, are slidably and sealingly mounted in the pressure chamber 41 for axial movements therein under the forces developed by fluid pressure supplied thereto. The upper annular piston 50 is provided with inner and outer O-ring seals 50*a* and 50*b* which respectively cooperate in sealing relationship with the outer peripheral surface of the intermediate sleeve 20 and the inner bore surface 40*a* of the outer sleeve 40. Similarly, O-rings 60*a* and 60*b* are provided in the lower piston 60 to perform a similar function.

The top end of intermediate sleeve 20 is threadably secured by external threads 20*c* to an annular collar 21 which operates to produce a downwardly directed force on the adjacent elastomeric seal assembly 36 which abuts one end of the slip mechanism 30. The lower end of intermediate sleeve 20 defines a collet portion 22 which comprises a plurality of peripherally spaced, axially split, collet arms 22*a* having external left hand threads 22*b* formed thereon, which cooperate with internal left hand threads 61 formed on the interior of the lower piston 60. Collet arms 22*a* are inherently spring biased inwardly and are held in their outer position shown in FIG. 1C by a radially enlarged wall portion 10*e* of inner sleeve 10. Lower piston 60 is employed to impart a downwardly directed force to the intermediate sleeve 20 and thus produce a downwardly directed compression force that is effective on the slip mechanism 30, as well as the elastomeric seal assembly 36.

Figure 5C:
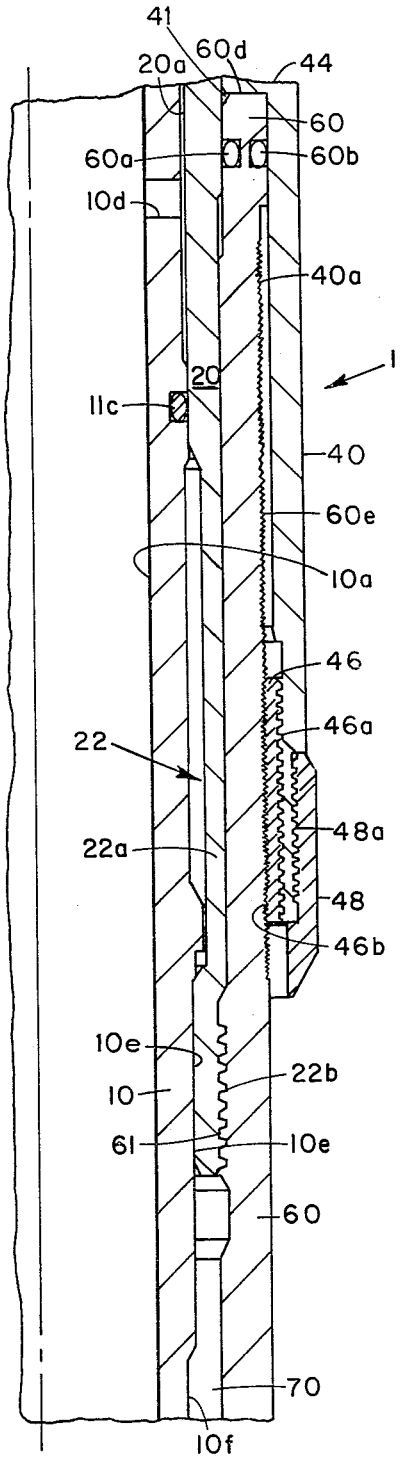
Figure 5D:
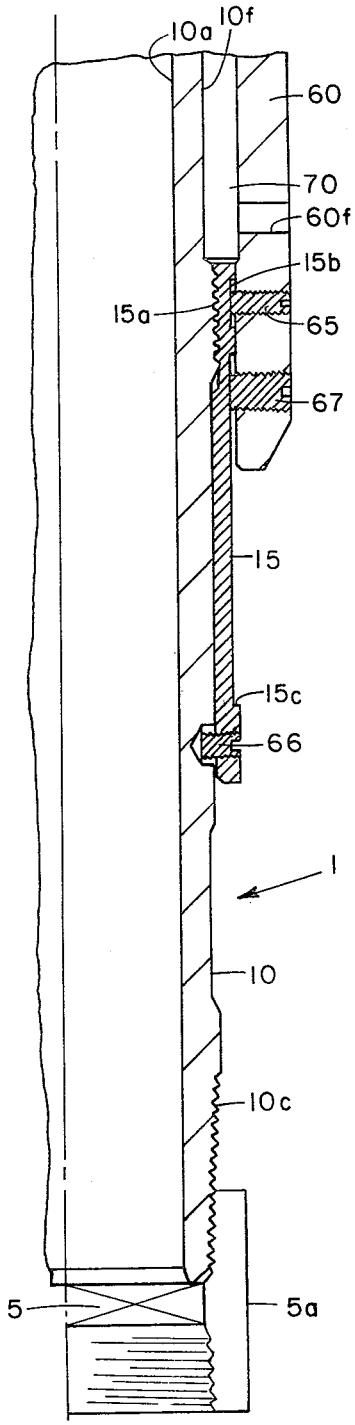

In the run-in position of the packer, as illustrated in FIGS. 5*b* and 5*c*, the bottom surface 50*c* of upper piston 50 is disposed in abutment with an internal shoulder 44 provided on outer sleeve 40. At the same time, the top surface 60*d* of lower piston 60 abuts the downwardly disposed face of shoulder 44. To maintain the two pistons 50 and 60 in this inoperative position during run-in, an expandable locking ring 55 is provided, which is mounted in an appropriate groove 20*b* formed in the outer periphery of the intermediate sleeve 20. Ring 55 is preferably fabricated from an elastic metal and is of C-shaped configuration so that it inherently tends to expand itself out of the groove 20*b*. Inclined shoulders on ring 55 and groove 20*b* facilitate such outward movement.

Locking ring 55 is retained in the groove 20*b* by an axial annular extension 50*d* formed on the bottom end of upper piston 50. Thus, until upper piston 50 is moved upwardly by fluid pressure forces applied thereto, the entire assemblage thus far described, including the inner sleeve 10, intermediate sleeve 20, outer sleeve 40, and both the upper piston 50 and the lower piston 60 is held in an interlocked, immobile position irrespective of the fact that the bottom ends of outer sleeve 40 and lower piston 60 may be subjected to jarring impacts during the run-in of the packer assemblage into the well.

The upper end of annular upper piston 50 moves into abutment with the lower cone or cam element 31 of the previously described slip mechanism 30. It is therefore apparent that the application of a compressive force to the upper and lower cam or cone elements 31 and 32 will force the slip elements 33 and 34 in a radially outward direction to concurrently engage the downwardly facing teeth 33*a* and the upwardly facing teeth 34*a* with the casing wall 2.

The lower annular cam or cone element 31 is provided with external threads 31*c* which are engagable with internal threads 40*c* provided in the top end of the outer sleeve 40. A set screw 42 secures such threads against accidental unthreading. During run-in of the apparatus, one or more radially disposed shear screws 51 are provided in the outer sleeve 40 which respectively cooperate with an annular groove 50*f* provided in upper piston 50 to prevent upward movement of upper piston 50 until sufficient fluid pressure force is applied to the fluid pressure chamber 41 to effect the severing of the shear screws 51. The upper annular piston 50 is then free to move into abutment with the bottom face of the lower cam member 31 of the slip mechansim 30. In this position, the annular piston 50 will resist any downward movement of the lower cam element 31, hence a downward force applied to the slip mechanism 30 by the abutment collar 21 carried by the intermediate sleeve 20 will effect a radially outward expansion of the slip elements 33 and 34 carried by the slip mechanism 30. Concurrently, the annular elastomeric sealing assembly 36 will be compressed to expand radially outwardly into sealing engagement with the wall of the casing 2.

The annular elastomeric sealing assembly 36 preferably comprises a three element structure respectively constituting a relatively soft annular mass 36*a* surrounded on each axial end by relatively harder elastomeric annular masses 36*b* and 36*c*. The contacting surfaces 36*d* and 36*e* are oppositely tapered in conventional fashion. These elastomeric sealing elements are thus concurrently compressed between the downwardly facing shoulder 21*a* of the annular abutment collar 21 and the end 32*d* of upper cam element 32 and the upwardly facing shoulder 29*a* of thrust collar 29, which is threadably secured by threads 32*e* to the upper end of the upper cam or cone element 32.

The diameters of the abutment collars 21 and 29 are as large as will permit the convenient insertion of the packing apparatus in the casing and hence, when the packer is set and the annular elastomeric seal assembly 36 is compressed to expand outwardly, there will inherently be a tendency of the elastomeric material of the seal elements to cold flow or extrude into the annular spaces defined between the peripheries of the thrust transmitting collars 21 and 29 and the casing wall 2.

It is apparent that the application of pressured fluid to the annular pressure chamber 41 will concurrently force the upper piston 50 in an upward direction and the lower piston 60 in a downward direction. The initial movement of upper piston 50 will effect the shearing of the run-in shear pins 51 which are provided in the outer sleeve 50 and the upper piston 50 will move into solid abutting engagement with the bottom cam or cone element 31 of the slip mechanism 30. Concurrently, the lower piston 60 is moved downwardly and, due to the collet thread connection 22*b* of such piston with the intermediate sleeve 20, a compressive force is exerted on the slip mechanism 30.

Such compressive force is locked into the slip mechanism 30 by virtue of a ratcheting thread connection provided between the outer surface of the lower piston 60 and the internal surface of a ratcheting sleeve 46, which is secured by threads 46*a* to the bottom end of the outer sleeve 40. Such bottom end of the external sleeve 40 is also externally threaded to receive the internal threads 48*a* of a gage ring 48 which is provided solely as a means for protecting the following slip mechanisms from contact with obstructions in the casing bore as the packer mechanism is lowered into the well.

The ratcheting thread connection is defined by inclined external threads 60*e* provided on the outer periphery of the lower piston 60 and similarly inclined internal threads 46*b* provided on the internal surface of the rachet sleeve 46. Such ratcheting threads have the property of permitting downward relative movement of the lower piston 60 with respect to the outer sleeve 40, but preventing any upward relative movement. Thus, the compressive forces applied to the elastomeric seal assembly 36 are effectively retained therein, due to the fact that the intermediate sleeve 20 is rigidly locked against motion in a force releasing direction by virtue of the collet thread connection 22*b* of intermediate sleeve 20 to the lower piston 60 and the outer sleeve 40.

It should, however, be noted that in the event that the elastomeric material of seal assembly 36 should extrude sufficiently to cause a loss in sealing effectiveness, the restoration of a fluid pressure within the bore of the inner sleeve 10 will again effect a downward compressing movement of the intermediate sleeve 20 to further compress the elastomeric seals and restore them to full effectiveness. This action can occur regardless of the fact that the inner sleeve 10 is relatively axially immobile due to its rigid connection to other elements in the production string and slips 33 and 34 are immobily secured to casing wall 2.

This slip mechanism not only allows further compression to be applied to an extruded seal, but premature release due to a combination of annulus pressure and seal extrusion will be avoided. When seal element 36 establishes sealing integrity in the annulus between the inner and outer conduit, the pressure above the packer will generally be different from that below the packer. In conventional double acting packers, and in this configuration a member such as the intermediate sleeve 20 is subject to this pressure differential. Therefore when the pressure above the packer is greater than the pressure below a net downward force will be applied to intermediate sleeve 20. If intermediate sleeve 20 moves downward relative to lower cam element 31, the slip assembly and the elastomeric seal 36 will be further compressed to increase both the anchoring and sealing effectiveness. As previously described the ratcheting means between second piston 60 and outer sleeve 40 are configured to prevent only upward movement of the piston 60 and attached intermediate sleeve 20 relative to outer sleeve 40 and its attached lower cam element 31. Although the ratcheting means will allow movement in the opposite direction, there is still a tendency for outer sleeve 40 and lower cam element 31 to move downwardly as intermediate sleeve 20 and piston 60 are moved downward. Especially where extrusion of the elastometic seal 36 may have introduced some slack or play into the combined packing and slip system, this downward force applied to lower cam element 31 might in a conventional slip assembly be sufficient to dislodge the wedging engagement between cam element 31 and slips 33. Slip mechanism 30 is specifically adapted to overcome this problem. The T-shaped or tongue and groove engagement between wedged slips 34 and lower cam 31 will resist this downward force. Therefore the wedging engagement between slips 34 and cam element 32, which will be enhanced by the same force acting downwardly on intermediate sleeve 20 will cause cam element 31 and outer sleeve 40 to remain stationary. In other words, the T-shaped engagements of the slips and the cam elements transmits axial forces between such components. Intermediate sleeve 20 and piston 60 will therefore ratchet downward relative to sleeve 40 as desired. There will thus be no tendency for slips 33 and cam element 31 to dislodge. Of course, the symmetrical nature of this slip assembly would accomplish the same result if the ratcheting action were located above the slips for preventing movement in the opposite direction.

It was previously mentioned that slips 33 and 34 are of identical configuration. Moreover, it will be noticed that each slip has an annular segment cross section. These features permit the slips to be economically manufactured by axially slitting a sleeve-like blank on which the cutting teeth of the eventual slips have already been formed. This greatly reduces the amount of machining time required to produce the slips 33 and 34.

Although the invention has been described in terms of specified embodiments which are set forth in detail, it should be understood that this is by illustration only and the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. In a packer for subterranean wells having a casing, an inner elongated sleeve having means on the upper end thereof for attachment to a control element, the improvement comprising: an intermediate sleeve surrounding said inner sleeve and slidable thereon; an annular slip mechanism surrounding said intermediate sleeve; said annular slip mechanism comprising first and second of annular cam elements adapted to be mounted in axial alignment for slidable movements on said intermediate sleeve, said cam elements respectively having a plurality of peripherially spaced axially extending slots; the slots in said first cam element being offset from the slots in said second cam element, the slots in said first cam element having bottom surfaces inclined in the opposite direction from the inclined bottom surfaces of the slots in the second cam element; a set of first slip members respectively radially disposed in the slots in said first cam element; a set of second slip members respectively radially disposed in the slots in said second cam element; and cam surfaces formed on a portion of the inner faces of said slip members for cooperably engaging the inclined bottom surfaces of said axial slots in said cam elements for camming all of said slips radially outwardly in response to relative axial movement of said cam elements to wedge said slips into engagement with an exterior and vertical bore wall; means operatively connecting said intermediate sleeve to one of said cam elements; an outer sleeve surrounding a medial portion of said intermediate sleeve and defining an annular chamber therebetween; port means in said inner sleeve and said intermediate sleeve for supplying pressured fluid to said annular chamber; one axial end of said outer sleeve being connected to the other of said cam elements; a first annular piston in said annular chamber movable into abutment with said other cam element for applying an upward force thereto upon the application of fluid pressure to said annular chamber; a second annular piston in said annular chamber, means for detachable securement of said intermediate sleeve to said second annular piston, thereby applying an axial compressive force to said one cam element; and means on the outer wall of said second piston for ratcheting engagement with the inner wall of said outer sleeve, thereby locking said intermediate sleeve and said slip mechanism in a radially expanded, set position engaging the casing wall.

2. The improvement of claim 1 wherein an annular elastomeric seal element is disposed around said intermediate sleeve adjacent said one cam element; and said means operatively connecting said intermediate sleeve and said one cam element comprises an abutment on said intermediate sleeve compressively forcing said annular elastomeric sleeve against said end of said one cam element.

3. A tool operatively connected to an inner conduit received within an outer conduit in a subterranean well having means for anchoring said tool to said outer conduit to prevent axial movement in both directions, said tool comprising: a set of peripherally spaced, radially expandable first slip elements for engaging the outer conduit to prevent movement in a first direction and a set of peripherally spaced, radially expandable second slip elements for engaging the outer conduit to prevent movement in a second opposite direction; first and second housing elements movable relatively towards each other; means for urging said first and second slip members radially outward into engagement with said outer conduit upon movement of said first and second housing elements relatively towards each other; a member in abutting relationship with said first housing element to urge said first housing element in a first direction toward said second housing element; means for preventing axial movement of said member relative to said second housing element in a second opposite direction; and means for attaching said first slip elements to said second housing element so that said first slip elements upon engagement with the outer conduit prevent said second housing element from moving in said first direction with said member when said member moves in said first direction whereby said second slip elements will not be dislodged from engagement with said outer conduit.

4. A tool operatively connected to an inner conduit received within an outer conduit in a subterranean well having means for anchoring said tool to said outer conduit to prevent axial movement in both directions, said tool comprising: a set of peripherally spaced, radially expandable first slip elements for engaging the outer conduit to prevent movement in a second opposite direction; first and second cam elements movable relatively towards each other, said first cam element wedging said first slip elements into engagement with said outer conduit upon such relative movement and said second cam element wedging said second slip elements into engagement with said outer conduit upon such relative movement; a member in abutting relationship with and urging said first cam element in a first direction toward said second cam element; means for preventing axial movement of said member relative to said second cam element in a second opposite direction; and means for attaching one axial end of each said first slip elements to said second cam element so that wedging engagement of said first slip elements and said first cam element prevent said second cam element from moving in said first direction with said member upon movement of said member in said first direction, whereby said second slip elements will not be dislodged from wedging engagement with said second cam element.

5. A tool operatively connected to an inner conduit received within an outer conduit in a subterranean well having means for anchoring said tool to said outer conduit to prevent axial movement in both directions, said tool comprising: a set of peripheral radially expandable first slip elements for engaging the outer conduit to prevent movement in a first direction and a set of peripherally spaced, radially expandable second slip elements for engaging the outer conduit to prevent movement in a second opposite direction; first and second cam elements movable relatively towards each other, said first cam element wedging said first slip elements into engagement with said outer conduit upon such relative movement and said second cam element wedging said second slip elements into engagement with said outer conduit upon such relative movement; a member in abutting relationship with said first cam element to urge said first cam element in a first direction toward said second cam element, said member being subject to the pressure differential in the annulus between said inner and outer conduit, above and below said tool; means for preventing axial movement of said member relative to said second cam element in a second opposite direction; and means for attaching said first slip elements to said second cam element so that wedging engagement of said first slip elements and said first cam element prevent said second cam element from moving in said first direction with said member when said member moves in said first direction under the action of the pressure differential in said annulus above and below said tool whereby said second slip elements will not be dislodged from wedging engagement with said second cam element.

6. A tool operatively connected to an inner conduit received within an outer conduit in a subterranean well having means for anchoring said tool to said outer conduit to prevent axial movement in both directions, said tool comprising: a set of peripheral radially expandable first slip elements for engaging the outer conduit to prevent movement in a first direction and a set of peripheral radially expandable second slip elements for engaging the outer conduit to prevent movement in a second opposite direction; first and second cam elements movable relatively towards each other, said first cam element wedging said first slip elements into engagement with said outer conduit upon such relative movement and said second cam element wedging said second slip elements into engagement with said outer conduit upon such relative movement; an annular elastomeric seal element for establishing sealing integrity in the annulus between said inner and outer conduit, disposed adjacent to said first cam element; a member abutting said elastomeric seal and urging said first cam element in a first direction toward said second cam element, means for preventing axial movement of said member relative to said second cam element in a second opposite direction; and means for attaching said first slip elements to said second cam element so that wedging engagement of said first slip elements and said first cam element prevent said second cam element from moving in said first direction with said member upon movement of said member in said first direction, whereby said second slip elements will not be dislodged from wedging engagement with said second cam element.

7. The tool of claim 6 wherein said member comprises an intermediate sleeve extending axially within said peripheral slip elements.

8. The tool of claim 7 further comprising an inner sleeve contained within and movable relative to said intermediate sleeve and attached to said inner conduit.

9. The tool of claims 6, 7 or 8 wherein said means for preventing axial movement of said member relative to said second cam element in a second opposite direction comprises ratcheting means.

10. The tool of claims 6, 7 or 8 wherein said member comprises an intermediate sleeve extending axially within said peripheral slip elements and further comprising an outer sleeve attached to said second cam element and wherein said means for preventing axial movement of said member relative to said second cam element in a second opposite direction comprises ratcheting means for preventing movement of said intermediate sleeve relative to said outer sleeve in said second opposite direction.

11. The tool of claims 6, 7 or 8 wherein said means for attaching said first slip elements to said second cam element comprise T-shaped members cooperable with T-shaped inclined grooves.

12. The tool of claim 11 wherein said T-shaped member is on the end of each of said first slips and said T-shaped inclined grooves are on said second cam elements.

13. The tool of claim 12 wherein engagement of said second cam element with the T-shaped member on said first slips urges said first slips into wedging engagement with said outer conduit.

14. The tool of claim 6, 7 or 8 wherein said second slips are attached to said first cam elements.

15. The tool of claim 14 wherein said first slips are identical to said second slips.

16. The tool of claims 6, 7 or 8 wherein said member is subject to the pressure differential in the annulus, between said inner and outer conduit, above and below said elastomeric seal element.

17. The tool of claims 6, 7 and 8 wherein said first direction is toward the bottom of said subterranean well and said second direction is toward the surface of said subterranean well.

* * * * *